US007875166B2

(12) United States Patent
Matthäi et al.

(10) Patent No.: US 7,875,166 B2
(45) Date of Patent: Jan. 25, 2011

(54) MICROCRYSTALLINE PARAFFIN

(75) Inventors: Michael Matthäi, Henstedt-Ulzburg (DE); Günter Hildebrand, Rehmsdorf (DE); Helmuth Schulze-Trautmann, Hamburg (DE); Thorsten Butz, Hamburg (DE)

(73) Assignees: Sasol Wax International AG, Hamburg (DE); Sasol Wax GmbH, Hamburg (DE)

( * ) Notice: Subject to any disclaimer, the term of this patent is extended or adjusted under 35 U.S.C. 154(b) by 1139 days.

(21) Appl. No.: 10/477,910

(22) PCT Filed: May 31, 2002

(86) PCT No.: PCT/EP02/05970

§ 371 (c)(1),
(2), (4) Date: May 17, 2004

(87) PCT Pub. No.: WO02/096842

PCT Pub. Date: Dec. 5, 2002

(65) Prior Publication Data

US 2004/0192979 A1 Sep. 30, 2004

(30) Foreign Application Priority Data

May 30, 2001 (DE) ..... 101 26 516

(51) Int. Cl.
*C10G 73/00* (2006.01)
*C10M 159/06* (2006.01)

(52) U.S. Cl. ..... 208/24; 208/20; 208/21; 208/950; 508/450

(58) Field of Classification Search ..... 208/20, 208/21, 24, 950
See application file for complete search history.

(56) References Cited

U.S. PATENT DOCUMENTS

| | | | | |
|---|---|---|---|---|
| 4,419,220 | A | 12/1983 | LaPierre | |
| 4,995,962 | A * | 2/1991 | Degnan et al. | 208/110 |
| 5,904,834 | A | 5/1999 | Leenhouts et al. | |
| 5,908,968 | A * | 6/1999 | Carati et al. | 585/734 |
| 5,981,419 | A * | 11/1999 | Carati et al. | 502/66 |
| 6,080,301 | A * | 6/2000 | Berlowitz et al. | 208/18 |
| 6,179,994 | B1 * | 1/2001 | Clark et al. | 208/27 |
| 6,310,265 | B1 * | 10/2001 | Chester et al. | 585/739 |
| 6,475,960 | B1 * | 11/2002 | Berlowitz et al. | 508/110 |
| 6,773,578 | B1 * | 8/2004 | O'Rear et al. | 208/28 |
| 6,776,898 | B1 * | 8/2004 | Wittenbrink et al. | 208/89 |
| 7,169,726 | B2 | 1/2007 | John et al. | |
| 7,179,764 | B2 * | 2/2007 | Basso et al. | 502/60 |
| 2004/0199040 | A1 | 10/2004 | Hoek et al. | |
| 2006/0118462 | A1 | 6/2006 | Schulze-Trautmann et al. | |

FOREIGN PATENT DOCUMENTS

| | | |
|---|---|---|
| EP | 0435619 | 7/1991 |
| EP | 668342 | 8/1995 |
| EP | 776959 | 6/1997 |
| WO | 0174969 | 10/2001 |

* cited by examiner

*Primary Examiner*—Ellen M McAvoy
(74) *Attorney, Agent, or Firm*—Lucas & Mercanti, LLP

(57) ABSTRACT

The invention relates to a novel and completely synthetic microcrystalline paraffin, said paraffin being obtained in a simple manner and with a high yield by the catalytic hydromerisation of paraffin FT comprising 20 to 105 carbon atoms. Said paraffins can be pasty to solid at room temperature and have a higher percentage of iso-paraffins than n-paraffins. Since they do not contain aromatic compounds they are particularly suitable for use in the pharmaceutical, cosmetic and food industries.

6 Claims, 2 Drawing Sheets

MICROCRYSTALLINE PARAFFIN

FIELD AND BACKGROUND OF THE INVENTION

Figure 1A:
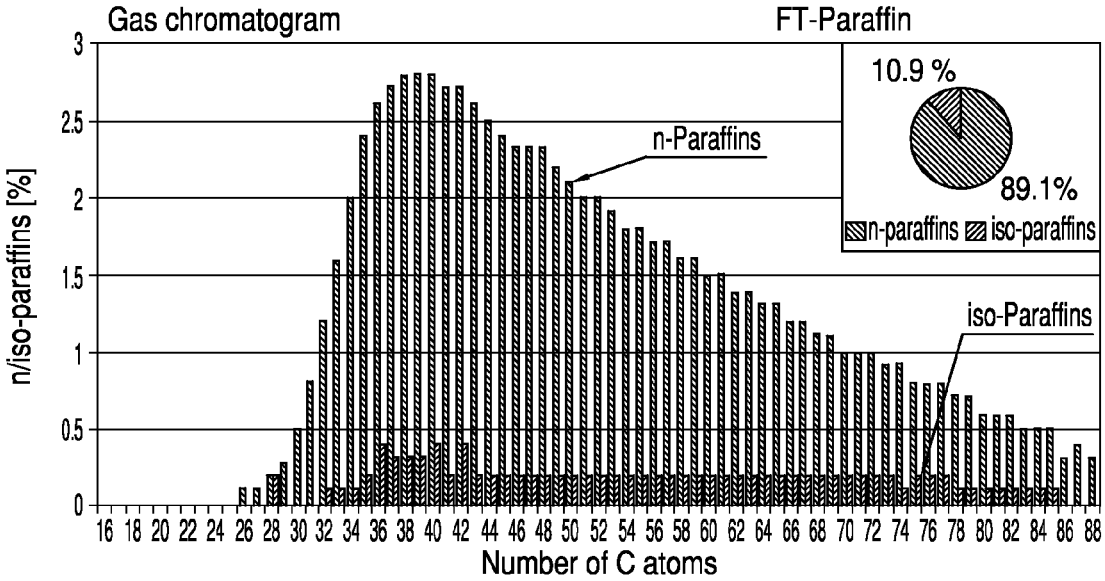
Figure 1B:
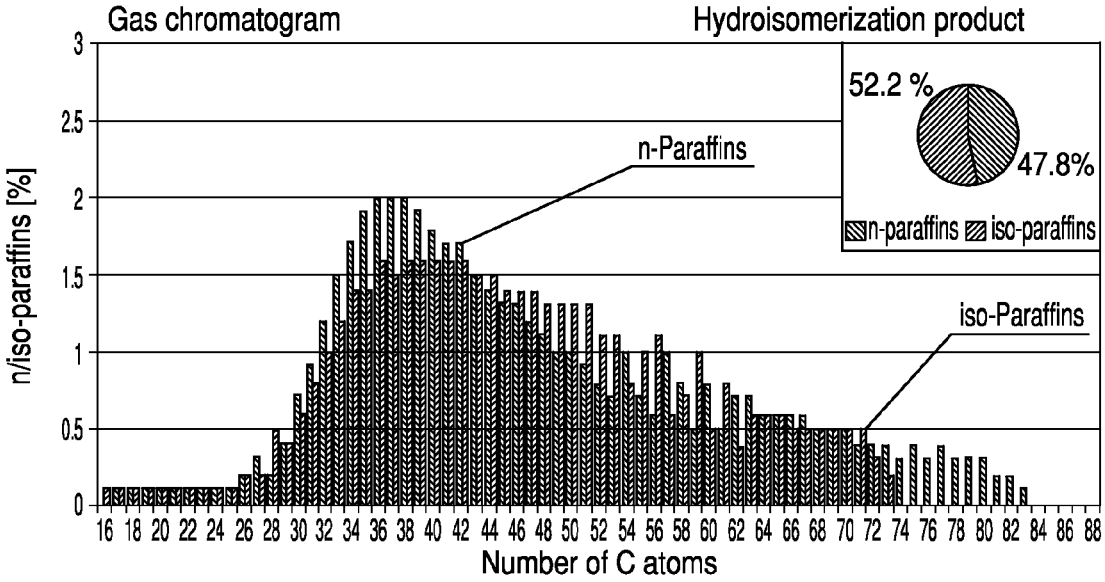
Figure 1C:
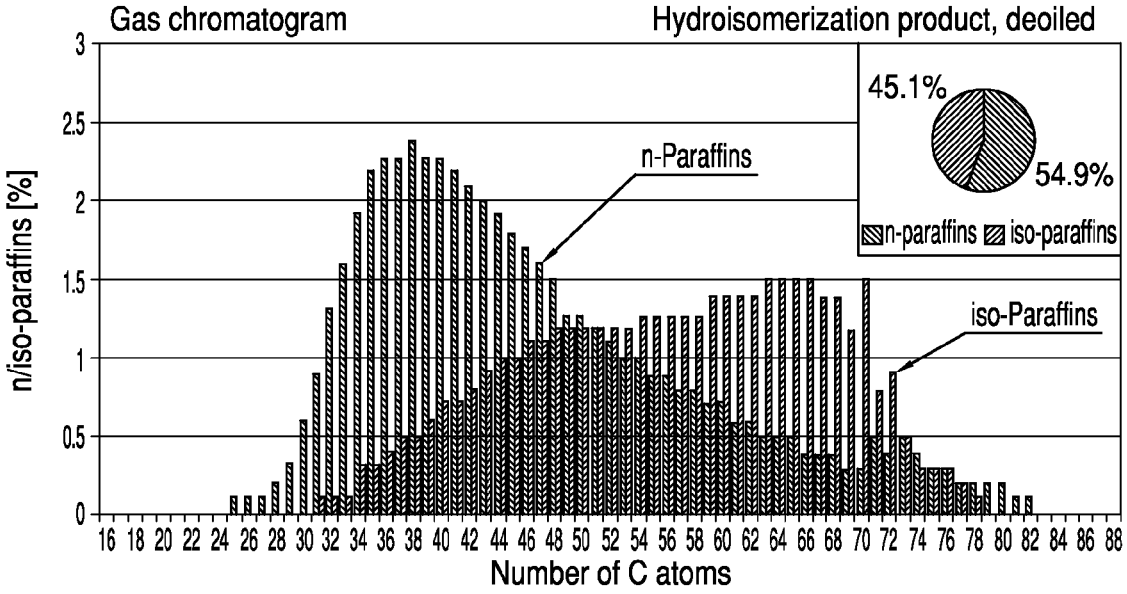

The invention relates to a microcrystalline paraffin, its preparation and its use.

Conventional microcrystalline paraffin obtained from mineral oil (also known as microwaxes) comprises a mixture of saturated hydrocarbons which are solid at room temperature and have a chain length distribution of $C_{25}$ to $C_{80}$. In addition to n-alkanes, the microcrystalline paraffins often contain branched isoalkanes and alkyl-substituted cycloalkanes (naphthenes) and proportions—even if generally small ones—of aromatics. The content of isoalkanes and of naphthenes is from 40 to 70%, determined according to EWF Standard Test Method for Analysis of Hydrocarbon Wax by Gas Chromatography. The quantitative dominance of the isoalkanes (and of the naphthenes) is due to their microcrystalline structure.

The solidification range is between 50 and 100° C. according to DIN ISO 2207. The needle penetration has values between $2\times10^{-1}$ and $160\times10^{-1}$ mm according to DIN 51579. The solidification point and the needle penetration are used for distinguishing among the microcrystalline paraffins between plastic and hard microcrystalline paraffins. Soft plastic microcrystalline paraffins (so-called petrolatums) are tacky with a very pronounced adhesive power, and they have solidification points of from 65 to 70° C. and penetration values of from 45 to 160×10−1 mm. The oil contents are from 1 to 15%. Plastic microcrystalline paraffins are readily deformable and kneadable and have solidification points between 65 and 80° C. and penetration values of from 10 to $30\times10^{-1}$ mm. The oil contents may be up to 5%. The hard microcrystalline paraffins are tough and slightly tacky with solidification points of from 80 to 95° C. and penetration values of from 2 to $15\times10^{-1}$ mm. The oil contents are not more than 2% (cf. Ullmanns Enzyklopädia of Industrial Chemistry, VCH-Verlags-gesellschaft 1996).

Microcrystalline paraffins have a high molar mass and hence high boiling points. They have been obtained to date from the residues of vacuum distillation of mineral oil, in particular in the production of lubricating oil (residue waxes), and from deposits of the mineral oil during its recovery, its transport and its storage, and in technologically very complicated and expensive processes having a plurality of stages, for example deasphalting, solvent extraction, dewaxing, deoiling and refining. The deoiled microcrystalline paraffins contain, as impurity, sulfur, nitrogen and oxygen compounds. They are accordingly not entirely odorless and have a dark yellow to dark brown color. The refinement therefore required is effected, depending on the later application, by bleaching (industrial applications) or by hydrorefining (applications in the food industry and pharmaceutical industry).

Microcrystalline paraffins are used predominantly as components in paraffin or wax mixtures. However, they are generally used in ranges up to 5%. In particular, hardness and melting point of these mixtures are to be increased and flexibility and oil binding capacity improved. Typical applications are, for example, the preparation of waxes for impregnation, coating and lamination for the packaging industry and textile industry, of heatseal and hotmelt adhesives and of pharmaceutical and cosmetic products, including chewing gum. Furthermore, they are used in casting compounds and cable materials and generally in plastics, but also in the candle, rubber and tire industries and in care, antislip and anticorrosion compositions.

DE 69 418 388 T2 describes a hydroisomerization of n-paraffins solid at room temperature and having more than 15 C atoms with use of a catalyst based on a metal of group VIII, in particular platinum, and a borosilicate having a β-zeolite structure to give products which are suitable for the preparation of lubricating oils. (Page 1)

Specifically, the following zeolites were mentioned: omega-zeolite, ZSN-5, X-zeolite, Y-zeolite and further zeolites.

DE 695 15 959 T2 describes the hydroisomerization of wax-containing starting materials to give products which are suitable for the preparation of lubricating oils. A temperature of from 270° to 360° C. and a pressure of from 500 to 1 500 psi or from 3.44 MPa to 10.36 MPa is used for this. The catalyst is based on a catalyzing metal component on a porous, heat-resistant metal oxide support. (cf. page 2, paragraph 1), in particular on from 0.1 to 5% by weight of platinum on alumina or zeolites, such as, for example, offretite, zeolite X, zeolite Y, ZSM-5, ZSM-2, etc. (cf. page 3, middle). The starting materials to be isomerized may be any wax or wax-containing material, in particular also a Fischer-Tropsch wax (cf. page 2, middle). The hydrogen is fed to the reactor at a rate of from 1 000 to 10 000 SCF/bbl and the wax at from 0.1 to 10 LHSV (cf. page 6, middle). The isomerization product is liquid (cf. page 7, line 7). It can be fractionated by distillation or by treatment with solvents, for example with an MEK/toluene mixture (cf. page 7, last paragraph).

The entire liquid product from the isomerization plant is more advantageously treated in a second stage under mild conditions with use of the isomerization catalyst based on a noble metal of group VIII and a heat-resistant metal oxide, in order to reduce PNA and other impurities in the isomerization product and thus to obtain an oil having improved, daylight stability (cf. page 8, paragraph 2). Mild conditions are to be understood as meaning: a temperature in the range from about 170° to 270° C., a pressure of from about 300 to 1500 psi, a hydrogen gas rate of from about 500 to 1 000 SCF/bbl and a flow rate of from about 0.25 to 10 vol./vol./h.

DE 38 72 851 T2 describes the preparation of a middle distillate fuel from a paraffin wax, in particular an FT wax (cf. claim 2), in which the wax is treated with hydrogen under hydroisomerization conditions in the presence of a specific catalyst based on a metal of group VIII, in particular platinum (claim 12), and alumina as support material, so that a medium distillate product and a bottom product having an initial boiling point above 371° C. are obtained (cf. claim 1), in particular a lubricating oil fraction having a low pour point (cf. claim 5). The wax is fed to the reactor at a rate of from 0.2 to 2 V/V. The hydrogen is fed to the reactor at a rate of from 0.089 to 2.67 $m^3$ $H_2$ per 1 l of wax. The catalyst has a decisive influence on the conversion. If it is based on platinum and a β-zeolite having a pore diameter of about 0.7 nm, the desired conversion to a middle distillate product is not observed, in particular with decreasing temperature to 293.9° C. (cf. example 3).

SUMMARY OF THE INVENTION

In comparison, it is an object of the invention to provide a novel microcrystalline paraffin, a process for its preparation and a use for this microcrystalline paraffin.

This object is initially and substantially achieved by the subject matter of a product claim herein or of a process claim herein or of a use claim herein. The aim of this is to obtain the microcrystalline paraffin, preparable by catalytic hydroisomerization at temperatures above 200° C., from paraffins obtained by Fischer-Tropsch synthesis (FT paraffins) with a C chain length distribution in the range from $C_{20}$ to $C_{105}$. Surprisingly, it has been found that such a microcrystalline paraffin is free of naphthenes and aromatics. It is furthermore surprising that, in spite of isomerization, crystallinity has been retained. A continuous preparation with defined properties is permitted. A product in the low and high solidification point range and referred to as a microwax is provided. A continuous or batchwise catalytic hydroisomerization of Fischer-Tropsch paraffins (FT paraffins) can be carried out. Regarding FT paraffins as such, reference should be made in particular to the statements by A. Kühnle in Fette, Seifen, Anstrichmittel [Fats, soaps, coating compositions], 84th year, page 156 et seq., "Fischer-Tropsch-Wachse Synthese, Struktur, Eigenschaften and Anwendungen [Fischer-Tropsch waxes, synthesis, structure, properties and applications]". In summary, the FT paraffins are paraffins which were prepared according to the Fischer-Tropsch process by known routes from synthesis gas (CO and $H_2$) in the presence of a catalyst at elevated temperature. They are the highest boiling fraction of the hydrocarbon mixture. Substantially long-chain, slightly branched alkanes which are free of naphthenes and aromatics and of oxygen and sulfur compounds form thereby.

Such FT paraffins having a high proportion of n-paraffins and a C chain length in the range from $C_{20}$ to $C_{105}$ are converted by the process described here into microcrystalline paraffins having a high melting point and a high proportion of isoparaffins.

According to the process aspect of the invention, the microcrystalline paraffin can be prepared by catalytic isomerization as follows:

A. Use of FT paraffin as starting material
   a) having a C chain length in the range from $C_{20}$ to $C_{105}$,
   b) preferably having a solidification point in the range from 70 to 105° C., in particular about 70, 80, 95 or 105° C. according to DIN ISO 2207,
   c) a penetration at 25° C. of from 1 to 15;
   d) a ratio of isoalkanes to n-alkanes of from 1:5 to 1:11
B. Use of a catalyst, preferably in the form of extrudates, spheres, pellets, granules or powders, expediently based on
   a) from 0.1 to 2.0, in particular from 0.4 to 1.0, % by mass, based on the catalyst calcined at 800° C., of hydrogenating metal of the eighth subgroup, in particular platinum, and
   b) a support material comprising a zeolite having a pore diameter in the range from 0.5 to 0.8 nm (from 5.0 to 8.0 Å),
C. Use of a process temperature of more than 200° C., in particular from 230 to 270° C.,
D. Use of a pressure of from 2.0 to 20.0, in particular from about 3 to 8, MPa in the presence of hydrogen and a ratio of hydrogen to FT paraffin of from 100:1 to 1 000:1, in particular from about 250:1 to 600:1, $m^3$(S.T.P.)/$m^3$.

Expediently, the loading of the reactor with the FT paraffin is in the range from 0.1 to 2.0, in particular from 0.2 to 0.8, v/v.h (volume of FT paraffin per volume of the reactor within one hour).

The yield of hydroisomerization products is between 90 and 96% by mass, based on the FT paraffin used in each case. With regard to alkanes having a low melting point, the hydroisomerization products obtained also contained alkanes in the C chain length range of <=$C_{20}$ up to 5% (as a rule up to 3%). These alkanes could be readily separated off by vacuum distillation with steam.

The catalyst used is preferably based on a β-zeolite.

The catalytic hydroisomerization of the FT paraffins is preferably carried out continuously in a flow-through reactor using a fixed-bed catalyst, in particular in the form of extrudates, spheres or pellets, it being possible for the flow through the reactor to be either from top to bottom or from bottom to top when said reactor is oriented vertically, as is preferred. However, the process can also be carried out batchwise in a batch process in, for example, a stirred autoclave, the catalyst being contained in a permeable net or being used finely distributed as granules or powder in the FT paraffin. The process parameters of the continuous and of the batchwise process are the same.

The microcrystalline paraffins obtained according to the invention have the following properties:

Compared with the FT paraffins used, they have lower solidification points and, in addition to n-alkanes, contain a high, in particular higher, proportion by weight of isoalkanes than of n-alkanes. The proportion of n-alkanes or isoalkanes is determined by gas chromatography. The increased degree of isomerization achieved by the hydroisomerization is expressed in increased penetration values, a reduced crystallinity and a reduced enthalpy of fusion. Moreover, these products have a pasty to tacky viscous consistency with a somewhat crumbly appearance.

The crystallinity is determined by X-ray diffraction analysis. It defines the crystalline fraction of the product obtained in relation to the amorphous fraction. The amorphous fractions lead to different diffraction of the X-rays from the crystalline fractions. The needle penetration at 25° C. in the case of the products according to the invention is in the range from 20 to 160, measured according to DIN 51579. The products obtained are solid at 20° C., in the sense that they do not run.

The crystalline fraction is reduced in particular as follows: while the starting material has a crystalline fraction in the range from 60 to 75%, a crystalline fraction of 30 to 45% is observable in the case of the hydroisomerization product. In particular in the range from 35 to 40 (36, 37, 38, 39) %.

The crystalline fractions and the amorphous fractions are specified by said X-ray diffraction analysis in each case in % by mass.

The microcrystalline paraffins prepared according to the invention from FT paraffins have physical and material properties which are similar or comparable to those of microcrystalline paraffins based on mineral oil (microwaxes).

The microcrystalline paraffins prepared by catalytic hydroisomerization can also be deoiled using a solvent. However, this does not mean that the hydroisomerization products described contain conventional oil. In any case, however, very short-chain n-alkanes or isoalkanes are removed. With the use of a solvent mixture of 95:5 parts by volume of dichloroethane: toluene and a product/solvent ratio of 1:3.6 parts at 22° C., a deoiled microcrystalline paraffin is obtained in a yield of from 80 to 90% by weight, based on the hydroisomerization product used. It has the following properties:

- Needle penetration: from $1\times10^{-1}$ to $7\times10^{-1}$, in particular from $3\times10^{-1}$ to $6\times10^{-1}$, mm, determined according to DIN 51579,
- oil content: from 1.0 to 2% by weight, in particular from 1.2 to 1.6% by weight, determined by MIBK according to modified ASTM D 721/87
- solidification point: from about 60 to about 95° C., in particular from 70 to 85° C., determined according to DIN ISO 2207.

Removing the oil thus converted the medium-hard product into a hard product when it is compared with the types based on mineral oil. The deoiled hydroisomerization product is then comparable with the hardest types based on mineral oil.

Owing to its properties, the microcrystalline hydroisomerization product prepared according to the invention and the corresponding deoiled microcrystalline hydroisomerization product can be used in the same way as a microwax (cf.

introduction). In particular, the hydroisomerization product obtained can also be oxidized. Oxidized products are obtained which differ according to melting range and degree of oxidation and are used in particular as corrosion inhibitors and as cavity and underfloor protection compositions for motor vehicles. They are moreover used in emulsions as care compositions and release agents and as additives for printing ink materials and carbon paper coloring materials.

The acid and ester groups, which are randomly distributed over hydrocarbon chains, can be reacted with inorganic or organic bases to give water-dispersible formulations (emulsifiable waxes) and lead to products having very good metal adhesion.

Further fields of use are the preparation of impregnating, coating and laminating waxes for the packaging and textile industries, heatseal and hotmelt adhesives, as a blend component in candles and other wax products, in wax mixtures for crayons, floor care compositions and automotive care compositions and for dental technology and pyrochemistry.

They are furthermore a component of light stabilizer waxes for the tire industry, electrical insulation materials, framework and pattern waxes for the precision casting industry and wax formulations for explosives, ammunition and propellant technology.

Such products are furthermore suitable as release agents in the pressing of wood, particle and fiber boards, in the production of ceramic parts and, owing to their retentivity, for the production of solvent-containing care compositions, grinding pastes and polishing pastes and as dulling agents for finishes.

Furthermore, these products can be used for the formulation of adhesive waxes, cheese waxes, cosmetic preparations, chewing gum bases, casting materials and cable materials, sprayable pesticides, vaselines, artificial chimneys, lubricants and hotmelt adhesives.

A test for food fastness is carried out, for example, according to FDA, §175.250.

The invention will now be explained in detail with reference to examples.

DESCRIPTION OF THE EXAMPLES

Example 1

An FT paraffin having a solidification point at 97° C. was catalytically isomerized with hydrogen at a pressure of 5 MPa (50 bar), a temperature of 270° C. and a v/v.h ratio of 0.3. The resulting hydroisomerization was demonstrated by characteristics in table 1.

The hydroisomerization product is white, odorless and slightly tacky and thus differs substantially from the brittle starting material. The isoalkane fraction is increased about 6-fold, which is demonstrated by the increased penetration value, the reduced crystallinity and the reduced enthalpy of fusion. On the basis of its characteristics, the synthetic, microcrystalline paraffin thus prepared is to be classified between a plastic and a hard microwax based on mineral oil. The hydroisomerization product was thus a paraffin having a pronounced microcrystalline structure, whose C chain length distribution of from 23 to 91 carbon atoms corresponds approximately to that of the starting material with from 27 to 95, but shifted toward smaller chain lengths. The chain length was determined by gas chromatography.

Example 2

An FT paraffin having a solidification point at 70° C. was catalytically isomerized with hydrogen at a pressure of 5 MPa (50 bar), a temperature of 250° C. and a v/v.h ratio of 0.3. The resulting structural conversion was demonstrated by the characteristics in the table.

The hydroisomerization product is white and odorless as well as pasty and slightly tacky. The isoalkane fraction is increased about 5-fold. The high degree of isomerization is expressed in the substantially increased penetration value, the reduced crystallinity and the reduced enthalpy of fusion. The microcrystalline paraffin thus obtained has a similar but slightly reduced C chain length compared with the FT paraffin, which is clear from the carbon atoms: from 23 to 42 in the case of the hydroisomerization product and from 25 to 48 in the case of the FT paraffin. On the basis of its characteristics, the synthetic microcrystalline paraffin thus prepared is comparable to a soft plastic microcrystalline paraffin obtained on the basis of mineral oil.

Examples 1 and 2 show that, by means of the process according to the invention, the FT paraffins, which predominantly comprise n-alkanes and have a finely crystalline structure and a brittle consistency, were converted into nonfluid, pasty or solid paraffins which have lower melting points than the starting materials. These paraffins are distinguished by a high content of branched alkanes and consequently have a microcrystalline structure with substantially reduced crystallinity and a plastic to slightly tacky consistency. The branched alkanes are predominantly methyl-alkanes, the methyl groups preferably occurring in the 2-, 3-, 4- or 5-position. Methyl-branched alkanes are also often formed in a small amount.

The results of examples 1 and 2, also compared with the starting material, are listed in the attached table 1.

Example 3

A catalyst (cylindrical extrudate, diameter 1.5 mm, length about 5 mm) was used in uncomminuted form. 92 ml of catalyst were introduced in undiluted form into the reactor tube (total volume 172 ml, internal diameter 22 mm). The catalyst zone was also covered with a layer of the earth material. A thermocouple was positioned in the reactor in such a way that the temperature was measured at a depth of 2 cm and 17 cm of the catalyst bed. The catalysts were dried and activated (by means of high temperature, water is expelled and platinum reduced).

The paraffin starting material used was an FT paraffin C80 (solidification point 81° C., n-paraffin/isoparaffin mass ratio: 93.9/6.1). The oil content of the starting material was 0.5%. The needle penetration value was 6.0.

The experiments were carried out at a hydrogen pressure of 50 bar.

The following results were obtained: at 260° C. and 0.96 v/v.h, the iso fraction (% by mass) increased from 6.1 (FT paraffin) to 42 (hydroisomerization product). The solidification point was 77° C. and the oil content 18.8%. The needle penetration value was 32.

The catalyst was a platinum catalyst on β-zeolite. Regarding β-zeolites, reference is made to the publication "Atlas of Zeolite Structure Types", Elsevier Fourth Revised Edition, 1996.

Gas chromatograms obtained for this example are attached as an appendix.

In contrast to the microcrystalline paraffins obtained from mineral oil, the completely synthetic microcrystalline paraffins prepared by the hydroisomerization according to the invention contain no highly branched isoalkanes, no cyclic hydrocarbons (naphthenes) and in particular no aromatics and sulfur compounds. They thus meet the highest purity requirements for microcrystalline paraffins and are therefore outstandingly suitable for use in the cosmetic and pharmaceutical industries and for packaging and preservation in the food industry.

TABLE

Characteristics of starting materials and reaction products

| Characteristics | Unit | Method of measurement | Example 1 | | Example 2 | |
|---|---|---|---|---|---|---|
| | | | FT paraffin | Hydroisomer-ization | FT paraffin | Hydroisomer-ization |
| Solidification point | ° C. | DIN ISO 2207 | 97.0 | 86.5 | 71.5 | 61.5 |
| Penetration N at 25° C. | 0.1 mm | DIN 51579 | 2 | 42 | 13 | 98 |
| Enthalpy of fusion | J/g | ASTM D4419 | 221 | 127 | 195 | 120 |
| Crystallinity | % by mass | X-ray diffraction analysis | 70.7 | 43.5 | 62.4 | 38.8 |
| n-/iso-alkane weight ratio | % | Gas chromatography | 88/12 | 37/63 | 91/9 | 43/57 |
| Oil content (MIBK) | % by mass | ASTM D721-87 (modified) | 0.66 | 14.6 | 0.4 | 23.1 |

The invention claimed is:

1. A process for the preparation of a micro-crystalline paraffin, having a solidification temperature range between 70 to 105° C. comprising contacting FT (Fischer-Tropsch) paraffins, as a starting material having carbon atoms in the range from 20 to 105, with a platinum catalyst based on a beta zeolite as support material, wherein the platinum content of the catalyst is from 0.4 to 1.0% by mass, based on the catalyst calcined at 800° C., and wherein the process is conducted at a temperature ranging from 230 to 270° C., and at a pressure in a range of 2 to 20 MPa in the presence of hydrogen, to provide a micro-crystalline paraffin, having a solidification temperature range between 70 to 105° C., and wherein the beta zeolite comprises a pore size between 0.50 and 0.80 nm.

2. Process according to claim 1, wherein the process is conducted at a pressure from 3 to 8 MPa.

3. Process according to claim 1, further comprising the step of applying a feed ratio of hydrogen to FT paraffin of from 100:1 to 1000:1 $m^3$ (S.T.P.) per $m^3$.

4. Process according to claim 3 wherein the feed ratio of hydrogen to FT Paraffin is from 250:1 to 600:1 $m^3$ (S.T.P.) per $m^3$.

5. Process according to claim 1, further comprising the steps of employing a loading of from 0.1 to 2.0 v/v. h.

6. Process according to claim 1, further comprising the steps of employing a loading of from 0.2 to 0.8 v/v.h.

* * * * *